US006981283B2

(12) United States Patent
Kujawski

(10) Patent No.: US 6,981,283 B2
(45) Date of Patent: Jan. 3, 2006

(54) GARDENING GLOVES WITH CUSHION INSERT TO PROTECT FINGERNAILS

(76) Inventor: Nancy C. Kujawski, 1405 Bishop, Grosse Pointe Park, MI (US) 48230

( * ) Notice: Subject to any disclaimer, the term of this patent is extended or adjusted under 35 U.S.C. 154(b) by 165 days.

(21) Appl. No.: 10/664,501

(22) Filed: Sep. 16, 2003

(65) Prior Publication Data

US 2005/0055754 A1 Mar. 17, 2005

(51) Int. Cl.
*A41D 19/00* (2006.01)

(52) U.S. Cl. ..... 2/161.6; 2/160; 2/163; 2/168

(58) Field of Classification Search ..... 2/159, 2/161.6, 164, 163, 169, 161.1, 161.7, 239, 2/240, 241; 132/76.2, 73.6, 285
See application file for complete search history.

(56) References Cited

U.S. PATENT DOCUMENTS 1,437,318 A 11/1922 Kyle
3,386,104 A 6/1968 Casey
4,694,508 A * 9/1987 Iriyama et al. ..... 2/21
4,774,727 A * 10/1988 Jackson ..... 2/161.8
4,867,246 A 9/1989 Kiger
4,995,119 A 2/1991 Codkind
5,093,933 A * 3/1992 Berry ..... 2/161.6
5,752,279 A 5/1998 Hochmuth
5,761,743 A 6/1998 Andrews et al.
5,842,227 A 12/1998 Rabin et al.
5,881,388 A 3/1999 Pratt
6,743,190 B2 * 6/2004 Connelly et al. ..... 604/4.01

* cited by examiner

*Primary Examiner*—John J. Calvert
*Assistant Examiner*—Richale Haney
(74) *Attorney, Agent, or Firm*—Brooks Kushman P.C.

(57) ABSTRACT

A gardening glove or the like designed to prevent fingernails which project beyond the end of a wearer's finger from being damaged during gardening comprises a sponge or foam insert in the distal ends of the finger stalls of the glove and having a horizontal slit for receiving the fingernail. The insert is held in compression by the walls of the finger stalls with the slit closed and opens to receive the nail. The insert may be adhesively secured to the wall of the finger stall.

6 Claims, 2 Drawing Sheets

GARDENING GLOVES WITH CUSHION INSERT TO PROTECT FINGERNAILS

BACKGROUND OF THE INVENTION

1. Field of the Invention

This invention relates to protective gloves and more particularly to a gardening glove especially suited to use by women to protect their finger tips and especially their fingernails.

2. Background

Long fingernails are especially prone to damage when a woman is gardening as the nails may strike rocks and small stones, roots and the like, or in doing household chores, the fingers may strike inadvertently against furniture and other hard objects which can cause cracking or breaking of the nails. I am not aware of any gloves especially designed for use by women which will protect their fingernails and which are comfortable to wear. Because the length of women's nails may vary from long to short, a glove is needed which will accommodate varying length of nails and protect them against damage from inadvertent contact with hard objects.

SUMMARY OF THE INVENTION

This invention provides a gardening glove especially designed for women with fingernails which may be easily damaged when gardening or performing other tasks that subjects the nails to risk of damage from encountering hard or sharp objects. This is accomplished by providing a foam insert in the distal end of each finger stall of the glove. The insert is held in compression within the finger stall and is provided with a slit lying in or parallel with the plane of the glove (herein sometimes referred to as a horizontal slit) and which will receive the fingertip and fingernail of the wearer. The slit in the foam insert is dimensioned so that it will encase both a short and a long fingernail.

DETAILED DESCRIPTION OF THE PREFERRED EMBODIMENT(S)

Figure 1:
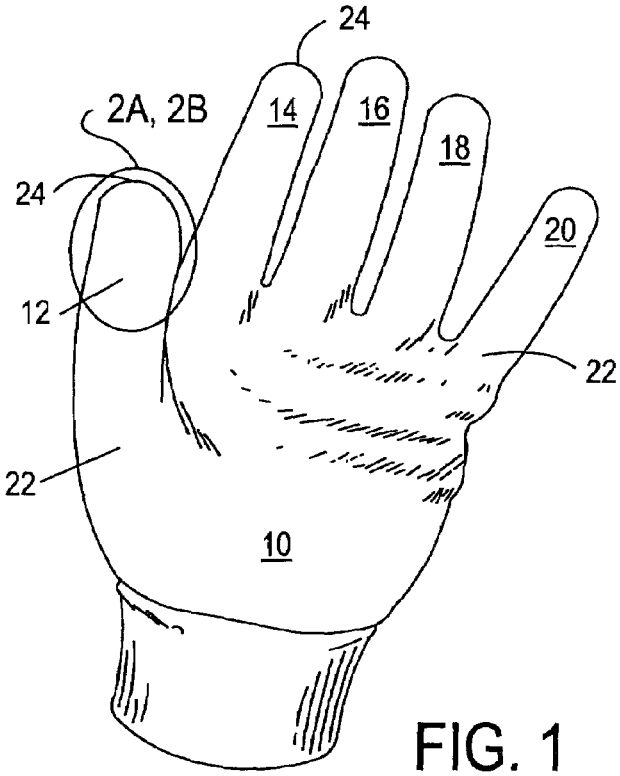
FIG. 1 shows a gardening glove embodying my invention.

In FIG. 1, I have shown a protective glove, such as a gardening glove, embodying my invention. The exact overall form and appearance of the glove may differ from that here depicted which is for purposes of explanation and not intended to be stylish.

The invention in prototype form has been constructed using readily available gardening gloves which have been modified as herein explained. The glove will typically comprise a fabric glove body 10 with finger stalls 12, 14, 16, 18 and 20, the glove body and stalls having been coated or impregnated with a moisture resistant layer of flexible plastic material. The finger stalls 12, 14,16,18 and 20 open interiorly into the body at their proximal ends 22 and are closed at their distal ends 24.

The distal end of each finger stall is provided with a compressible elastic foam insert, sometimes described as sponge rubber, which is water resistant. This type of foam is made by several companies and may be described as having a flexibility up to about 50%, an elasticity or expandability of about 25%–50%, and a density of from about ¼ inch to 2 inches. Flexibility was determined by bending the foam without it breaking. Bent at a right angle just before breaking, I considered about 50%, while bent double just before breaking, I considered 100%. I determined elasticity or expandability by stretching the foam. When it stretched one and one-quarter times its length without breaking, I considered that 25% and when stretched to one and one-half times its length and began to break, I considered that 50%. Density of ¼ inch will be suitable for a woman's glove, while for a man's glove, it may be two inches. All of these specifications may be varied to suit the particular circumstances.

Figure 4:
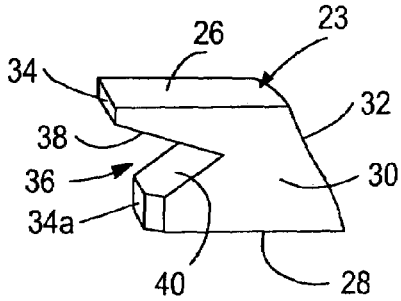
FIG. 4 shows a foam insert preparatory to insertion in the finger stall of a glove.

The foam, in the form of a foam block 23 measuring, for example, 1½ inches by ½ inch before insertion into the finger stalls is cut to the general shape shown in FIG. 4 where flat faces 26 and 28 are generally parallel, the side 30 and its complement (not shown) are also parallel, and the side 32 (only an edge of which is shown) is generally parallel to the side 34/34*a* interrupted by a wedge shaped notch 36. The notch is defined by an upper longer surface 38 and a lower shorter surface 40. The longer surface 38 is intended to overlay the upper surface of the finger tip 41 or 41*a* and fingernail 43 or 43*a*, while the shorter surface 40 underlies the finger tip and nail when the wearer inserts a hand into the glove with the fingernail aligned horizontally with the notch. The surface 40 is shorter because the face 34 of the block is cut away as at 34*a*.

Figure 3:
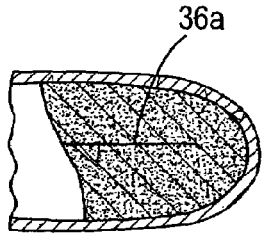
FIG. 3 shows an elastic compressible foam insert in the distal end of a finger stall with the insert held under compression by the walls of the finger stall and showing the horizontal slit in the insert.
Figure 5:
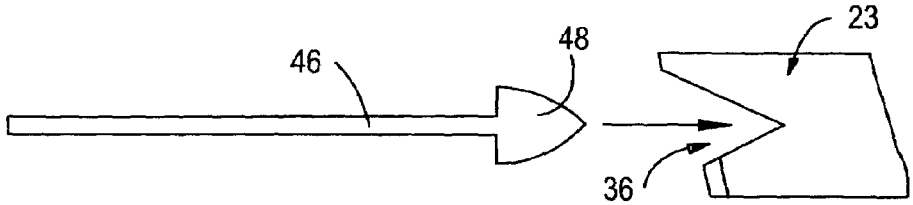
FIG. 5 shows schematically how the insert installing tool and the insert are oriented preparatory to pressing the insert into a glove.
Figure 6:
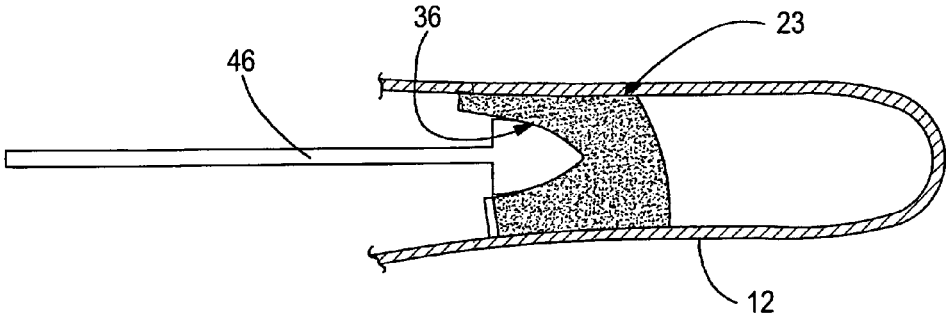
FIG. 6 shows the insert being pushed into a finger stall.
Figure 7:
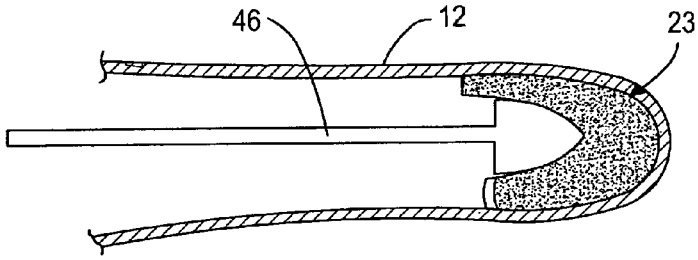
FIG. 7 shows the insert fully placed in the distal end of the finger stall of a glove in accordance with the invention.

As the sponge or foam block as depicted in FIG. 4 is inserted into the glove and finger stall as schematically shown in FIGS. 5–7, the block is squeezed together both vertically and horizontally thereby closing the notch which, as shown in FIG. 3 becomes a simple horizontal slit 36*a* in the foam. The squeezing together of the foam increases its density and accordingly its resistance to distortion as from a hard object against which the finger stall may be struck. The slit is oriented relative to the finger stall so that the slit is in a horizontal plane, which is a plane parallel to the general plane of the glove.

Figure 2A:
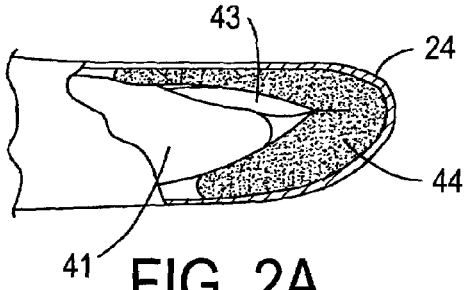
FIG. 2A shows a wearer's finger inserted in a finger stall of my improved glove, as at the area 2A of FIG. 1.
Figure 2B:
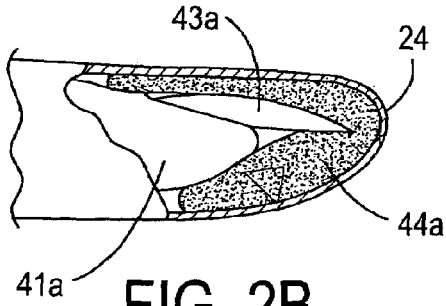
FIG. 2B shows a wearer with a longer fingernail than that of FIG. 2A inserted in a finger stall of my improved glove, as at the area 2B of FIG. 1.

The length of the sponge or foam is such, in combination with the length of the slit 36*a*, that the foam will completely encase the finger tip 41 and 41*a* and finger nail 43 and 43*a* of a wearer as shown in FIGS. 2A and 2B. Furthermore, the slit stops short of the extreme distal end of the stall such that a foam cushion of approximately ½ inch will exist beyond the distal end of the finger. Such cushion is shown at 44 and 44*a* in FIGS. 2A and 2B respectively.

As schematically depicted in FIGS. 5–7, the foam block 23 of FIG. 4 is inserted in the finger stalls of the glove by an arrow-shaped plunger 46 whose head 48 is received in the notch 36 as shown in FIG. 6. The arrow is oriented such that the slit 36*a* resulting after withdrawal of the plunger is disposed with the slit in a horizontal plane.

The foam inserts may be retained in the finger stalls by adhesive retention or by sewing. For adhesive retention, the foam block may be coated on the surfaces, except the surfaces 38 and 40, with a heat-activated adhesive, and then the foam inserted in the stalls. When in place, the stalls are subjected to heat sufficient to effect bonding of the foam within and to the walls of the stalls.

By forming the glove of water resistant materials, they may be washed as desired, and suitable decorations imprinted thereon to make them attractive and stylish.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A gardening glove for protecting the fingertips and fingernails of a wearer's hand comprising:

a main body portion for reception of the wearer's hand and having finger stalls for reception over the wearer's fingers;

compressible elastic foam held under compression within and by the finger stalls at the distal ends thereof;

said foam having a horizontal slit therein of a length sufficient to allow the foam to open for receiving the finger tip and finger nail of a wearer's hand when inserted into the glove with the foam at the upper side of the slit overlying the top of the finger tip and nail and the foam at the under side of the slit underlying the bottom of the finger tip and nail;

said slit in the foam terminating sufficiently short of the extreme distal end of the finger stalls that a foam cushion is disposed between the end of the fingernail and the end of the finger stall whereby the finger tip and fingernail of a wearer's hand inserted in the glove is protected from damage.

2. The glove of claim 1 wherein the foam at the upper side of the slit which overlies the upper side of the finger tip and fingernail, is longer that the foam which underlies the horizontal slit in the foam.

3. The glove of claim 1 wherein the compressible elastic foam is squeezed together closing the slit in the foam when inserted into the finger stall and held in compression therein for reception of the finger tip and finger nail of the wearer of the glove.

4. The glove of claim 1 wherein the foam is adhesively secured to the inside of the finger stalls.

5. The method of making a gardening glove comprising:

pressing into each finger stall of a glove body an elastic foam insert having a transverse slit therein extending across the insert but terminating short of the distal end with each insert oriented such that the slit is horizontal when the glove lies in a horizontal plane;

the foam insert being sized in relation to each finger stall such that the insert is held in compression by the finger stall and the slit held closed pending insertion of a wearer's hand into the glove with the finger tips and fingernails entering the slits.

6. The method of claim 5 wherein adhesive is applied to the insert before it is inserted into its respective finger stall, and the adhesive is cured to adhere the insert to the finger stall there within.

* * * * *